US005392801A

United States Patent [19]

Hannoosh et al.

[11] Patent Number: 5,392,801

[45] Date of Patent: Feb. 28, 1995

[54] SELF RIGHTING WALKING CANE

[76] Inventors: Mitchell M. Hannoosh, 26 Morrison Rd., Wakefield, Mass. 01880; James G. Hannoosh, 76 Beverly Dr., Avon, Conn. 06001

[21] Appl. No.: 171,236

[22] Filed: Dec. 21, 1993

[51] Int. Cl.[6] ..... A45B 1/00

[52] U.S. Cl. ..... 135/65; 135/77; 135/84

[58] Field of Search ..... 135/65, 66, 77, 84, 135/85

[56] References Cited

U.S. PATENT DOCUMENTS

| | | | |
|---|---|---|---|
| 2,642,074 | 6/1953 | Pedley et al. . | |
| 3,877,697 | 4/1975 | Lersch . | |
| 4,562,850 | 1/1986 | Earley et al. . | |
| 4,947,882 | 8/1990 | Levasseur | 135/84 |
| 4,995,845 | 2/1991 | Hou . | |
| 5,088,513 | 2/1992 | Ostermeyer | 135/84 X |

FOREIGN PATENT DOCUMENTS

| | | | |
|---|---|---|---|
| 591827 | 9/1977 | Switzerland | 135/77 |

*Primary Examiner*—Lanna Mai

*Attorney, Agent, or Firm*—Edward A. Gordon

[57] ABSTRACT

A self righting walking cane device which comprises a lightweight hand grip handle, a lightweight shaft device and a bottom weighted base device to facilitate the righting action of the cane device. The base device includes a plurality of frame devices and faceted shell sections which are attached about the bottom portion of the shaft device. The frame devices or shell have a unique configuration which together with the weight device positioned about the bottom portion of shaft device which together with unique shaft configuration provide a unique self righting walking cane. This combination of elements produces a cane whose center of gravity is below the center of rotation of the righting surface causing the cane to remain vertically stable and if disturbed from its vertical position to return to it. The construction of the cane device also allows it to stand by itself without the need of support.

9 Claims, 4 Drawing Sheets

SELF RIGHTING WALKING CANE

BACKGROUND OF THE INVENTION

1. Field Of The Invention

The present invention relates to a walking appliance such as a stick or short staff and more particularly to a self righting walking cane for invalids and others in walking who, for example, may be unable to or have difficulties in bending down to pick up a device such as a fallen down cane. In addition, the self righting walking cane of the present invention is free standing and vertically stable.

2. Description Of Prior Art

There are numerous devices in the prior art to assist persons with ambulatory problems such as conventional crutches, walking sticks and canes. These devices are generally traditionally fitted with simple rubber end fittings for reducing the extent to which they slip on the ground.

Various devices have already been proposed to remedy these drawbacks. These devices include a tube suitable for being used interchangeably with any type of crutch or walking stick and receiving a special foot which is articulated to the tube by a ball-and-socket joint. In addition, the foot includes a plurality of resilient projections for providing better adherence on the ground over an area which is very large compared with the area actually used by one of the above mentioned single end pieces. The ball-and-socket joint allows the foot firstly to rotate freely relative to the tube, thereby ensuring that wear takes place uniformly on the projections, and secondly it allows it to adapt to ground irregularities.

However, for some people, these crutches or sticks suffer from a further drawback. Should they be accidentally dropped on the ground, they cannot easily be retrieved by their handicapped users who generally also have difficulty in bending down.

U.S. Pat. No. 4,947,882 discloses a walking stick which comprises a riser, a foot defining a supporting polygon, a ball-and-socket joint connecting the riser to the foot, and resilient means for keeping the riser in a determined position relative to the foot, such that when the foot stands on substantially horizontal ground and when the resilient means are in the holding position, the riser remains in a substantially vertical position, with the supporting polygon being defined by five end fittings positioned substantially at the vertices of a pentagon.

U.S. Pat. No. 2,642,074 discloses a walking appliance which comprises an upright member having a hand grip thereon, a transverse member having open ends and fixed to the lower end of said upright member, a substantially V-shaped member having inturned ends received in said open ends so as to be pivotally associated with said transverse member and forming therewith a substantially triangular base adapted to rest on a supporting surface, and means for selectively securing said V-shaped member in extended position to rest on a supporting surface or in collapsed position.

The foregoing patents as well as the following U.S. patents are believed to exemplify the present state of the art with respect to such rotating and uprighting devices:

U.S. Pat. No. 4,995,845

U.S. Pat. No. 4,562,850

U.S. Pat. No. 3,877,697

While such prior art devices provide improvement in the areas intended, there still exists a need for a self righting walking cane device which overcomes the disadvantages of the prior art devices while providing utility features which provide new and useful advantages and improvements not heretofore disclosed.

Accordingly, a principle desirable object of the present invention is to provide a new and improved self righting walking cane device which overcomes the disadvantages of the prior art devices.

Another principle desirable object of the present invention is to provide a self righting cane that achieves its self righting capability by virtue of the fact that the center of gravity of the cane is below the center of rotation of the cane's restoring surface.

Another desirable object of the present invention is to provide a self righting walking cane device which includes a lightweight shaft device.

Another desirable object of the present invention is to provide a self righting walking cane device which includes an extremely lightweight handle.

Another desirable object of the present invention is to provide a self righting walking cane device which includes a weighted base and a curved surface device attached to the base to achieve the righting action.

Another desirable object of the present invention is to provide a self righting walking cane device with a faceted wire frame or shell made up of three to an infinite number of cylindrical or other appropriate curved facets to do the restoring action.

A further desirable object of the present invention is to provide a self righting walking cane which will stand upright by itself on a single surface without the need for support.

These and other desirable objects of the present invention will in part appear hereinafter and will in part become apparent after consideration of the specification with reference to the drawings and the claims.

SUMMARY OF THE INVENTION

The present invention provides a new and improved self righting walking cane device which is of particular advantage for individuals who are handicapped users who generally cannot or have difficulty in bending down to pick up a dropped cane, walking stick and the like. The self righting walking cane device includes a lightweight hand grip handle, a lightweight shaft device and a bottom weighted base device to facilitate the righting action of the cane device. The base device includes a plurality of frame or shell devices which are attached about the bottom portion of the shaft device. The frame devices or shell have a unique configuration which together with the weight device positioned about the bottom portion of shaft device which together with unique shaft configuration provide a unique self righting walking cane. This combination of elements produces a cane whose center of gravity is below the center of rotation of the righting surface causing the cane to remain vertically stable and if disturbed from its vertical position to return to it. The construction of the cane device also allows it to stand by itself without the need of support. This combination of elements can produce other useful items such as crutches and highway emergency markers.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 1:
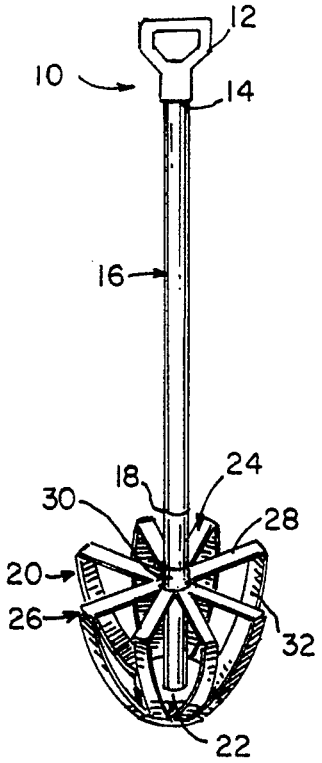
FIG. 1 is a perspective view of an embodiment of the self righting walking cane of the present invention.
Figure 3:
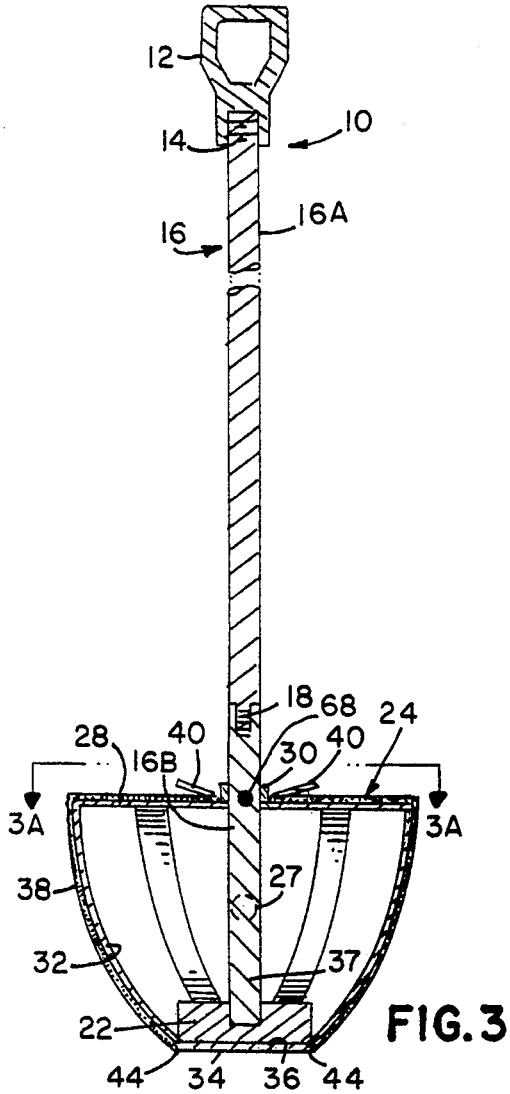
FIG. 3 is a fragmentary cross-sectional view of the self righting walking cane of FIG. 1 including the cover device of FIG. 2.

Referring now to the drawings and more particularly to FIGS. 1–3A, there is illustrated generally by the numeral 10 the self righting walking cane device hereinafter sometimes referred to as the cane device. The self righting cane device 10 consists of a lightweight handle 12 which is bonded to the top portion 14 of the shaft device 16. The handle 12 can be attached as screw adjustable as best illustrated in FIG. 3. The handle 12 can be attached to the shaft 16 in other means such as bonded adhesively to the lightweight tapered or straight shaft 16. The shaft device 16 can be formed as a singular unit or as indicated in FIGS. 1 and 3 be provided with an upper section 16A and a bottom section 16B with a screw adjustable portion 18 just above the base device 20. Attached about the bottom portion of the shaft device 16 is the weighted base device 22 which is below the upper portion of the base device 20 which cooperates with the configurations and positions of the frame devices 26 for righting of the cane 10 by causing the center of gravity position located as indicated by the dotted circle 27 of the cane 10 to be below the center of rotation as indicated by the dot 68 of the frame devices 26. The frame devices 26 are wire frame structures having a horizontal top end section 30 attached to the shaft device 16 and a downwardly and inwardly curved section 32 with the bottom end section 34 attached to the flat bottom section 36 of the weighted base device 22 attached to the bottom portion 37 of the shaft device 16. The bottom portion 36 of the weighted base device 22 is flat with an anti-slip surface so that the walking cane 10 can stand by itself without the need for support.

Figure 2:
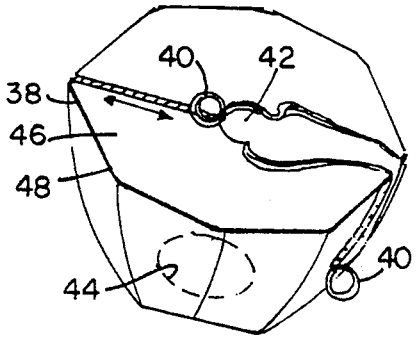
FIG. 2 is a perspective view of a cover device for the bottom portion of the present invention.
Figure 3A:
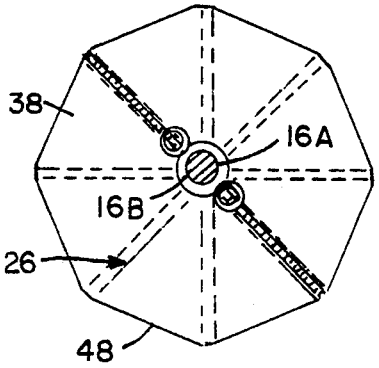
FIG. 3A is an upper view taken along the line 3A—3A of FIG. 3.

Referring to FIGS. 2, 3 and 3A there is illustrated an alternate embodiment whereby a cover device 38 is releasably attachable about the frame devices 26. As illustrated in FIG.2, the cover device 38 has top and partially side openings and locking sections 40 with a circular upper open section 42 to go about the upper portion of the bottom shaft device 16B and a bottom open section 44 to go about the bottom section 36 of bottom shaft device section 16B. An important feature of the cover device 38 is the upper section 46 which forms a straight side section 48 between the frame devices 26 which reduces the possibility of the cane device 10 rolling when initially falling whereby it self rights from the same position of falling. Without the cover device 38 the frame devices 26 provide this same improvement. The cover device 38 is preferably formed of lightweight relatively thin flexible fluid impervious plastic material such as polyethylene or polyvinyl chloride.

Figure 4:
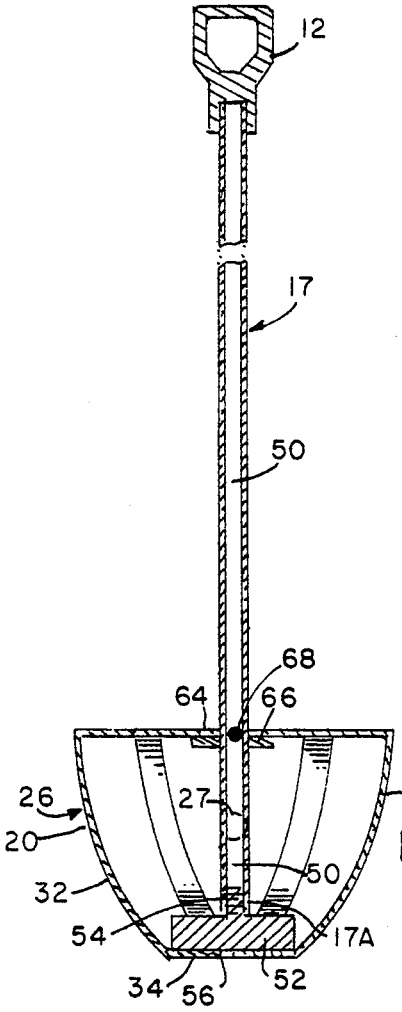
FIG. 4 is a fragmentary cross-sectional view of an alternate embodiment of the present invention.

Referring now to FIG. 4, there is illustrated an alternate embodiment of the self righting cane device 10. In this embodiment the shaft device 17 is a one piece thin walled hollow core 50 reinforced graphite composite or similar material which provides for a lightweight high strength and high stiffness shaft with a bottom weighted base device 52 which is attachable to the bottom shaft device section 17A by the threaded or adhesive bonding portion 54 and contains an anti-slip flat bottom portion 56 similar to the bottom portion 36 of FIG. 3. The lower end sections 34 of the righting frame devices 26 are attached to the bottom portion 56 in the same manner as FIG. 3. Adhesive bonding is the preferred method of attachment. The upper end portion 64 of the upper frame device section 28 is attached to the circular device 66 attached about the shaft device 17.

Figure 5A:
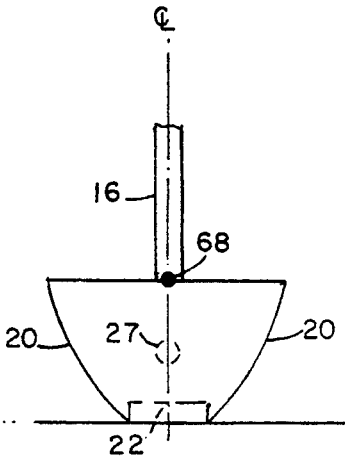
FIGS. 5A–C are fragmentary perspective views of the self righting walking cane of the present invention illustrating the principle by which the cane rights itself.
Figure 5B:
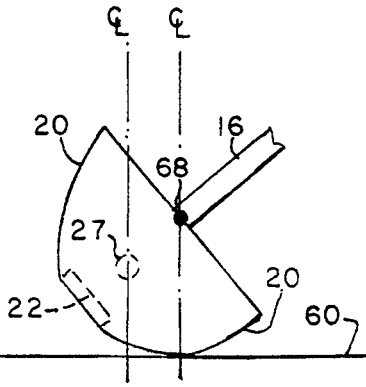
Figure 5C:
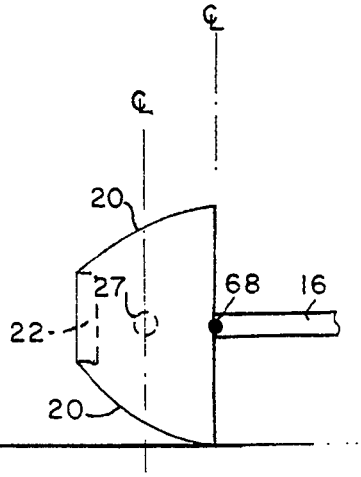

FIGS. 5A–C show on the walk area 60 the required locations of the center of gravity indicated by the center lines and the circular dots 27 of the assembly in relation to the center of rotation 68 dots of the righting surface 20. Since the center of gravity is always below the center of rotation there exists an unbalanced moment that causes the cane 10 to roll on the righting surface 20 to erect itself. At the end of the righting the unbalance moment goes to zero and rolling friction between the righting surface 20 and/or weight 22 and the floor 60 damp out the motion in a vertical standing position of FIG. 5A.

Figure 6A:
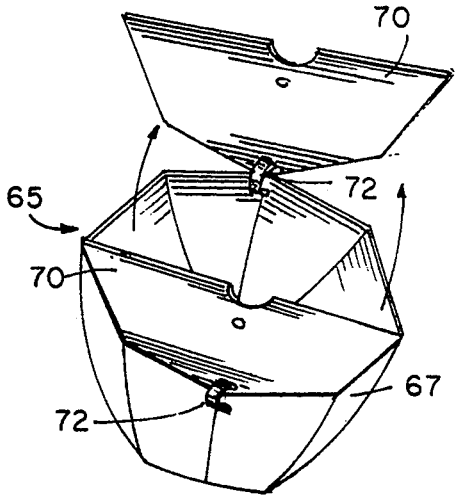
FIG. 6A is a perspective view of an alternate embodiment of a base shell device embodying the principles of the present invention.
Figure 6B:
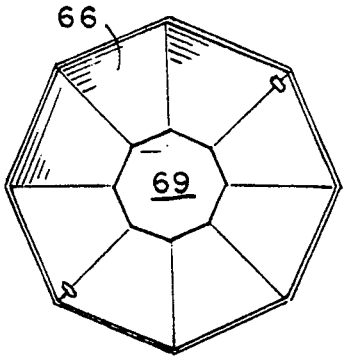
FIG. 6B is an upper view of the base shell device of FIG. 6A with the top cover devices off.
Figure 6C:
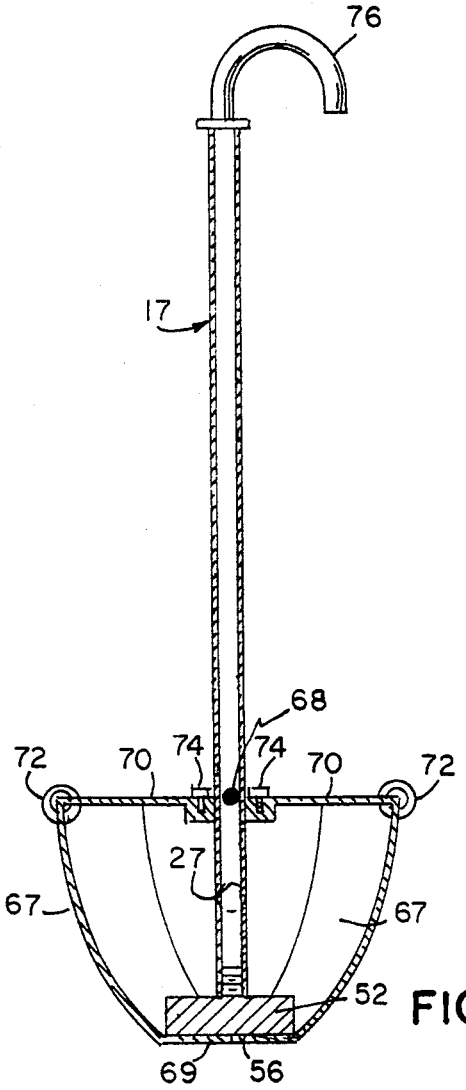
FIG. 6C is a fragmentary cross-sectional view of the base shell device of FIG. 6A attached in place of the frame device 26 of FIG. 4 and forming an alternate embodiment of the present invention.

Referring now to FIGS. 6A–6C, there is illustrated an alternate embodiment of a base shell device 65. The shell device 65 has downwardly and inwardly curved sections 67 with the bottom end sections 69 covering the flat bottom portion 56 of the bottom weighted base device 52. The top portion of the shell device 65 has two cover devices 70 which has rotating devices 72 to raise the cover devices 70. The cover devices 70 are provided with releasably attaching devices such as screws 74 which are releasably attachable to the circular device 67 which is attached about the shaft device 17. The shell device 66 is preferably formed of lightweight relatively thin reinforced plastic composite material such as glass filled polycarbonate or rigid polyvinylchloride and is used in place of the frame devices of FIG. 1. In this embodiment the hand grip device 76 is a lightweight U shaped handle.

Figure 8:
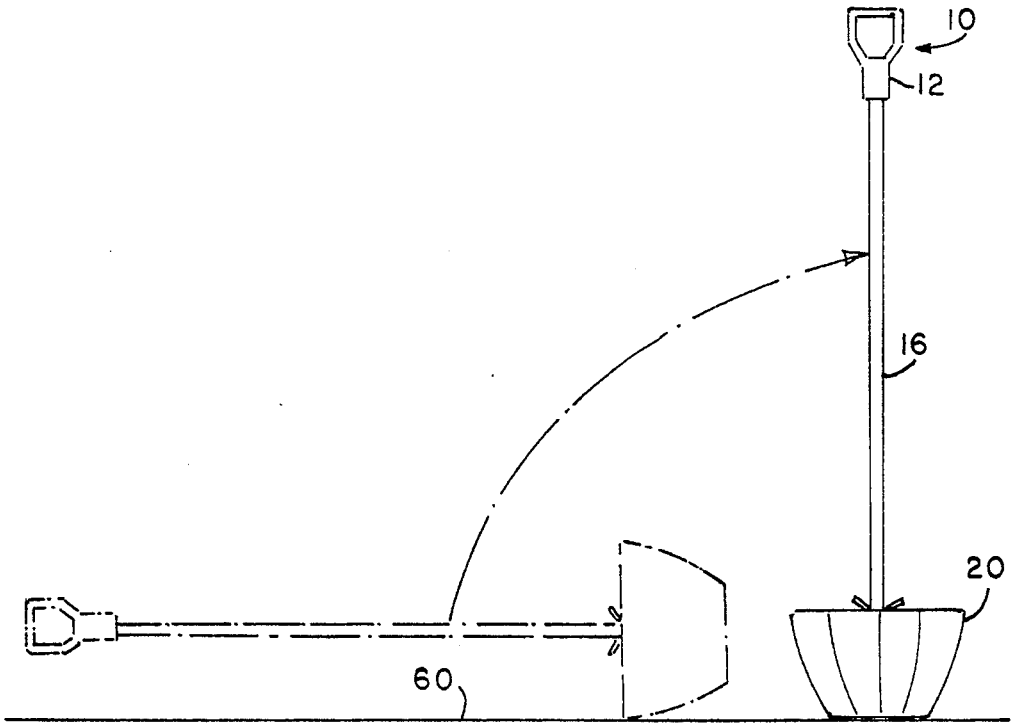
FIG. 8 is a perspective view illustrating a feature of the self righting cane device of the present invention.
Figure 7:
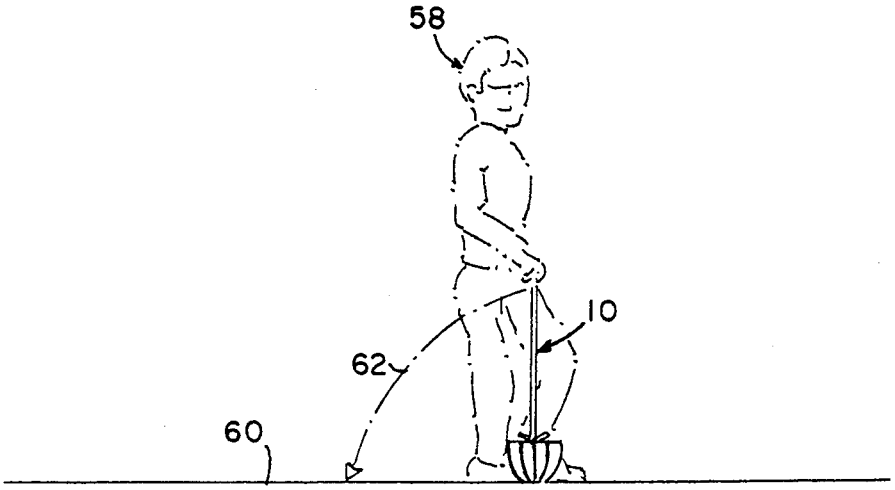
FIG. 7 is a perspective view illustrating a user walking with the self righting cane of the present invention as illustrated in FIG. 1.

Referring now to FIGS. 7 and 8, there is illustrated one example of the operation of the self righting walking cane 10 of the present invention. As illustrated in FIG. 7, if an individual 58 is walking along a walk area 60 with the self righting can device 10 and drops it backward as indicated by the line 62 and falls on the walk area 60 as indicated by the dotted lines of the self righting cane device 10 in FIG. 8 it will automatically self right back up immediately as indicated.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A self righting walking cane devices having a center of gravity and a center of rotation, wherein said center of gravity is below the center of rotation, said walking cane device comprising:

an elongated lightweight shaft device having an upper end and a bottom end;

a handle device attached to the upper end of the shaft device;

a weighted base device attached to the bottom end of the shaft device, said base device having a flat bottom portion;

a curved device comprising a plurality of frame devices each having an upper horizontal top section attached to a lower portion of the shaft device, and a downwardly and inwardly curved section attached to the weighted base device; and a flat bottom end section attached to the flat bottom section of the weighted base device.

2. The self righting walking cane device according to claim 1 further including a cover device releasably attachable about the curved device.

3. A self righting self standing walking cane device having a center of gravity and a center of rotation, wherein said center of gravity is below the center of rotation, said walking cane device comprising:

an elongated lightweight shaft device having an upper end and a bottom end;

a lightweight handle device attached to the upper end of the shaft device;

a weighted base device attached to the bottom end of the shaft device;

said weighted base device having a flat bottom end section which allows the cane to stand by itself; and a plurality of frame devices each having an upper horizontal top section attached to a lower portion of the shaft device, and a downwardly and inwardly curved section attached to the weighted base device.

4. The self righting self standing walking cane device according to claim 3 wherein the shaft device has an elongated inner center open thin walled hollow core section which contributes to the shaft lightweight.

5. The self righting self standing walking cane device according to claim 3 wherein the cane will restore itself via rolling if disturbed from its stable vertical position due to the fact that the center of gravity of the cane is below the center of rotation of the righting surface.

6. A self righting self standing walking cane device having a center of gravity and a center of rotation, wherein said center of gravity is below the center of rotation, said walking cane device comprising:

an elongated lightweight shaft device having an upper end and a bottom end;

said shaft device having an elongated inner center open hollow section which provides the shaft lightweight;

a lightweight handle device attached to the upper end of the shaft device;

a weighted base device attached to the bottom end of the shaft device;

said weighted base device having a flat bottom end section which allows the cane to stand by itself; and a plurality of frame devices each having an upper horizontal top section attached to a lower portion of the shaft device, and a downwardly and inwardly curved section attached to the weighted base device.

7. A self righting self standing walking cane device having a center of gravity and a center of rotation, wherein said center of gravity is below the center of rotation, said walking cane device comprising:

an elongated lightweight shaft device having an upper end and a bottom end;

a lightweight handle device attached to the upper end of the shaft device;

a weighted base device having a flat bottom end section which allows the cane to stand by itself; and a shell device having downwardly and inwardly curved sections with a bottom end section covering the flat bottom end section of the weight device and upper cover devices which are releasably attachable to the shaft device.

8. The self righting self standing walking cane device according to claim 7 wherein the shaft device has an elongated inner center open thin walled hollow core section which contributes to the shaft lightweight.

9. A self righting self standing walking cane device having a center of gravity and a center of rotation, wherein said center of gravity is below the center of rotation, said walking cane device comprising:

an elongated lightweight shaft device having an upper end and a bottom end;

said shaft device having an elongated inner center open hollow section which provides the shaft lightweight;

a lightweight handle device attached to the upper end of the shaft device;

a weighted base device attached to the bottom end portion of the shaft device;

said weighted base device having a flat bottom end section which allows the cane to stand by itself; and a shell device having downwardly and inwardly curved sections with a bottom end section covering the flat bottom end section of the weight device and upper cover devices which are releasably attachable to the shaft device.

* * * * *